US006945519B2

(12) United States Patent
Parker et al.

(10) Patent No.: US 6,945,519 B2
(45) Date of Patent: Sep. 20, 2005

(54) MICROORGANISM-RESISTANT HUMIDIFIER

(75) Inventors: Kenneth R. Parker, Delray Beach, FL (US); Michael E. Docherty, Boca Raton, FL (US); Gabriel S. Kohn, Boca Raton, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 74 days.

(21) Appl. No.: 10/670,624

(22) Filed: Sep. 25, 2003

(65) Prior Publication Data

US 2005/0067723 A1 Mar. 31, 2005

(51) Int. Cl.[7] ..... B01F 3/04

(52) U.S. Cl. ..... 261/26; 261/96; 261/99; 261/105; 261/DIG. 46

(58) Field of Search ..... 261/99, 26, 30, 261/72.1, 96, 102, 105, DIG. 46

(56) References Cited

U.S. PATENT DOCUMENTS 3,361,415 A * 1/1968 Lane ..... 261/2
3,840,001 A * 10/1974 Ernest ..... 126/113
4,510,766 A * 4/1985 Curtis, Sr. ..... 62/171
4,573,490 A * 3/1986 Kaletsky ..... 137/124
4,576,013 A * 3/1986 Sperr et al. ..... 62/171
4,764,661 A * 8/1988 Rautio ..... 392/402
5,547,615 A 8/1996 Jane et al.
5,783,117 A 7/1998 Byassee et al.
5,857,350 A 1/1999 Johnson et al.
6,053,482 A 4/2000 Glenn et al.
6,394,427 B1 5/2002 Guetersloh et al.
6,427,984 B1 8/2002 Mulvaney et al.
6,443,434 B1 * 9/2002 Prather ..... 261/26
6,550,748 B2 * 4/2003 Stanek et al. ..... 261/26

* cited by examiner

*Primary Examiner*—Scott Bushey
(74) *Attorney, Agent, or Firm*—Lawrence J. Shurupoff

(57) ABSTRACT

A humidifier has a first sealable reservoir feeding water to a second reservoir communicating with ambient atmosphere. A blower is adapted to blow a stream of air through the humidifier to ambient atmosphere, such that the stream of air picks up water vapor from any water that may be in the second reservoir. A feeder valve feeds a quickly-evaporable quantity of water from the first reservoir into the second reservoir. The quickly-evaporable quantity of water in the second reservoir is substantially smaller than the water capacity of the first reservoir. A dry-out mechanism shuts off the feeder valve upon a user command and continues to run the blower at least until the quickly-evaporable quantity of water has evaporated to an extent effective in inhibiting the growth of microorganisms in the microorganism-vulnerable reservoir.

17 Claims, 3 Drawing Sheets

MICROORGANISM-RESISTANT HUMIDIFIER

BACKGROUND OF THE DISCLOSURE

1. Field of the Disclosure

The present invention relates to humidifiers having water reservoirs and wicks that are resistant to microorganism growth.

2. Description of Related Art

A typical humidifier has a reservoir of water over or through which a stream of forced air is driven so as to pick up water vapor. The humidified airstream is then discharged to the ambient atmosphere, thereby increasing the humidity. Many humidifiers incorporate one or more wicks, the lower ends of which are located in a reservoir of water, thereby moistening the wicks. The large surface area of the wicks promotes rapid evaporation of water as the air stream is blown over and through them.

A common problem of humidifiers is the growth of microorganisms, such as mold spores and bacteria, in the water reservoir and wick when the humidifier is shut off for an extended period of time. Airborne microorganisms are then free to multiply in the stagnant water and in the moist wicks so long as a food supply is available. For simple reservoirs, the food supply includes contaminants in the water, either originally present in the water supply or deposited over time from contaminants in the airstream. Fortunately, these contaminants are usually in minute concentrations. For humidifiers that utilize wicks, however, the problem is more acute because the wick material itself is usually a fibrous organic material (e.g., paper, cotton or other textile) that is itself food to many microorganisms.

Various schemes are known in the art for destroying existing microorganisms in humidifier water reservoirs, such as heat, biocides, and filters. Such solutions are either energy intensive, require expensive chemicals and regular maintenance, or require the cleaning or replacement of expensive microfilters. In some cases anti-microbial material may be incorporated within the wicks to reduce mold growth.

A simple and inexpensive solution is to blow dry the reservoir when not in use. In actual operation, however, a shallow layer of water typically remains. Further, even if the water level in the reservoir went to zero, the wick would still be wet when the humidifier shuts off. A similiar solution is disclosed in Stanek et al., U.S. Pat. No. 6,550,748 B2, entitled DRY OUT MECHANISM FOR HUMIDIFIER, issued Apr. 22, 2003, wherein the user may put the humidifier in a "dry out" mode wherein the fan keeps blowing regardless of the water level.

A problem with a "dry out" mode type of humidifier is apparent when one considers the situation where the reservoir is nearly completely full and the user now desires to shut the humidifier off. For a typical home humidifier with a reservoir capable of holding one or more gallons of water, it could take hours, if not days, to dry out the reservoir. This is quite an uncomfortable situation for the user who wants the device shut off. Further, the user has to check upon the water level from time to time to check to see that the water is evaporated and any wick is dried out, so that the user may shut the device off.

One solution to this problem is to provide a dual reservoir system that may have one portion that is completely full, and another portion that is substantially empty, so that only a small amount of residual water need be evaporated to dry out the reservoir and any wicks.

SUMMARY OF THE DISCLOSURE

A microorganism-resistant humidifier includes a primary microorganism-resistant reservoir, a secondary microorganism-vulnerable reservoir and a blower adapted to blow a stream of air through the humidifier and out to an ambient atmosphere, such that the stream of air picks up water vapor from any water that may be in the secondary reservoir. A feeder valve is adapted to feed a small and quickly-evaporable quantity of water from the primary reservoir into the secondary reservoir, the quickly-evaporable quantity of water being substantially smaller than the water capacity of the primary reservoir. A dry-out mechanism is adapted to shut off the feeder valve upon a user command and continue to run the blower for a sufficient period of time at least until the quickly-evaporable quantity of water has evaporated to an extent effective in inhibiting the growth of microorganisms in the secondary reservoir, and wick if present.

The microorganism-resistant humidifier may further include one or more wicks located in the secondary reservoir. The primary reservoir may be sealed such as by a cap on the top portion of the primary reservoir and alternatively by a valve or by a shallow layer of water within the secondary reservoir. The primary reservoir is adapted to feed water downward into the secondary reservoir.

In another aspect of the microorganism-resistant humidifier, the quickly-evaporable quantity of water is evaporated in about one hour by a timed dry-out mechanism.

DETAILED DESCRIPTION OF PREFERRED EMBODIMENTS

Figure 1:
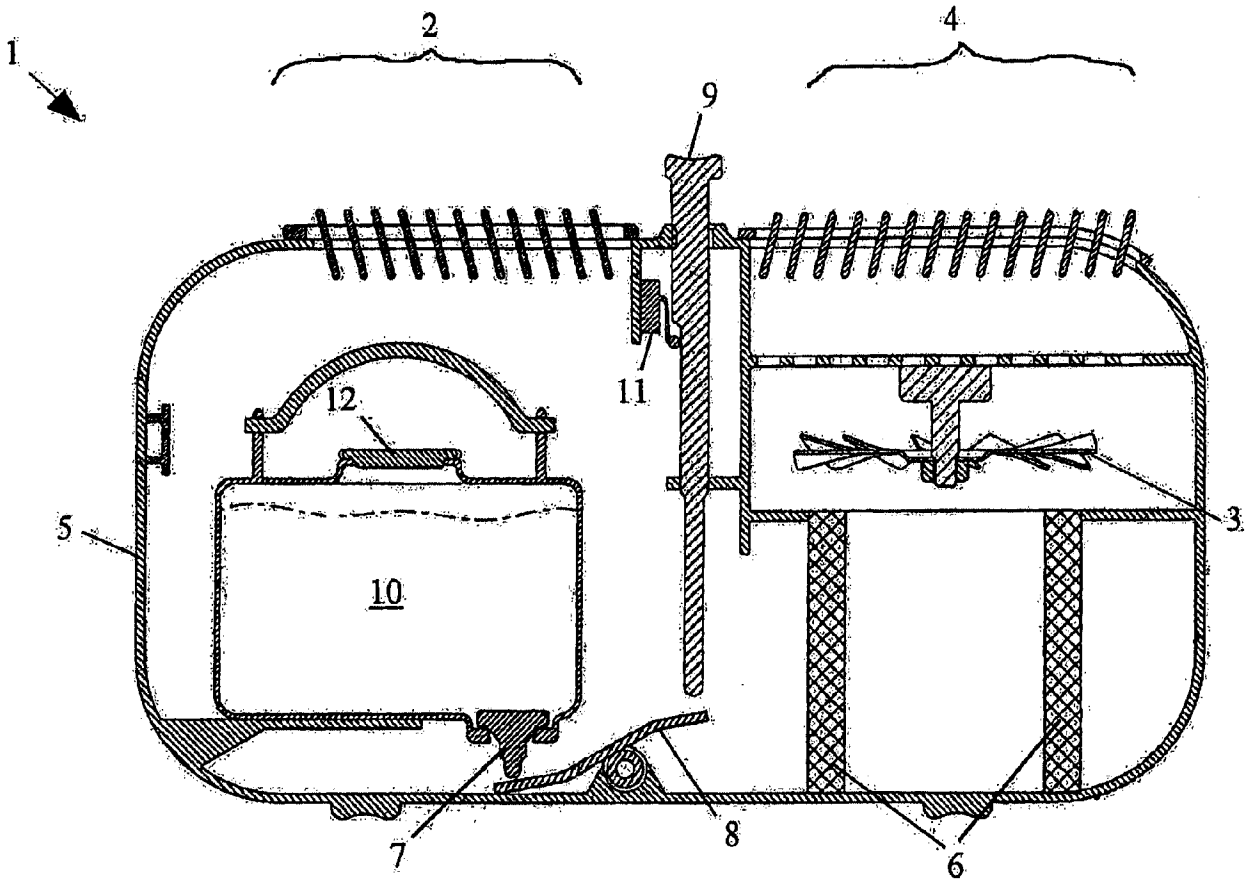
FIG. 1 is a cross-sectional view of an embodiment of the invention in an inactive mode.

Referring to FIG. 1, there is shown an embodiment of the humidifier 1 of the disclosure having a microorganism-vulnerable reservoir 5 and a microorganism-resistant reservoir 10. In the embodiment shown, the microorganism-resistant reservoir 10 serves as a primary or first reservoir and is preferably located inside the secondary microorganism-vulnerable reservoir 5, though this is not required.

The secondary reservoir owes its vulnerability to exposure to the ambient atmosphere via one or more intake vents 2 and exhaust vents 4. A fan or blower 3 is positioned to circulate air from the intake vents 2 through one or more wicks 6 and out the exhaust vents 4. The wick 6 is optional, though preferred because of the increased surface area it provides for more efficient evaporation of water. In the drawing, a single cylindrical wick 6 is shown, with the blower 3 positioned above it to vacuum or draw air out of the wick's interior.

The primary microorganism-resistant reservoir 10 owes its resistance to microorganisms and mold due to it being sealed off from the ambient atmosphere. A feeder valve 7 is provided to feed water from the primary microorganism-resistant reservoir 10 into the secondary microorganism-vulnerable reservoir 5. Feeder valve 7 may be biased closed by gravity or by a spring. Any number of ways may be provided to activate and open the feeder valve 7. One example is shown in the drawings wherein a rocker arm 8 is provided that engages with a power switching cammed shaft 9. Shaft 9 may be pushed down by a user to rotate the rocker arm so as to open the feeder valve 7 and simultaneously cam closed and activate a power switch 11 to feed power to and activate the blower 3.

Figure 2:
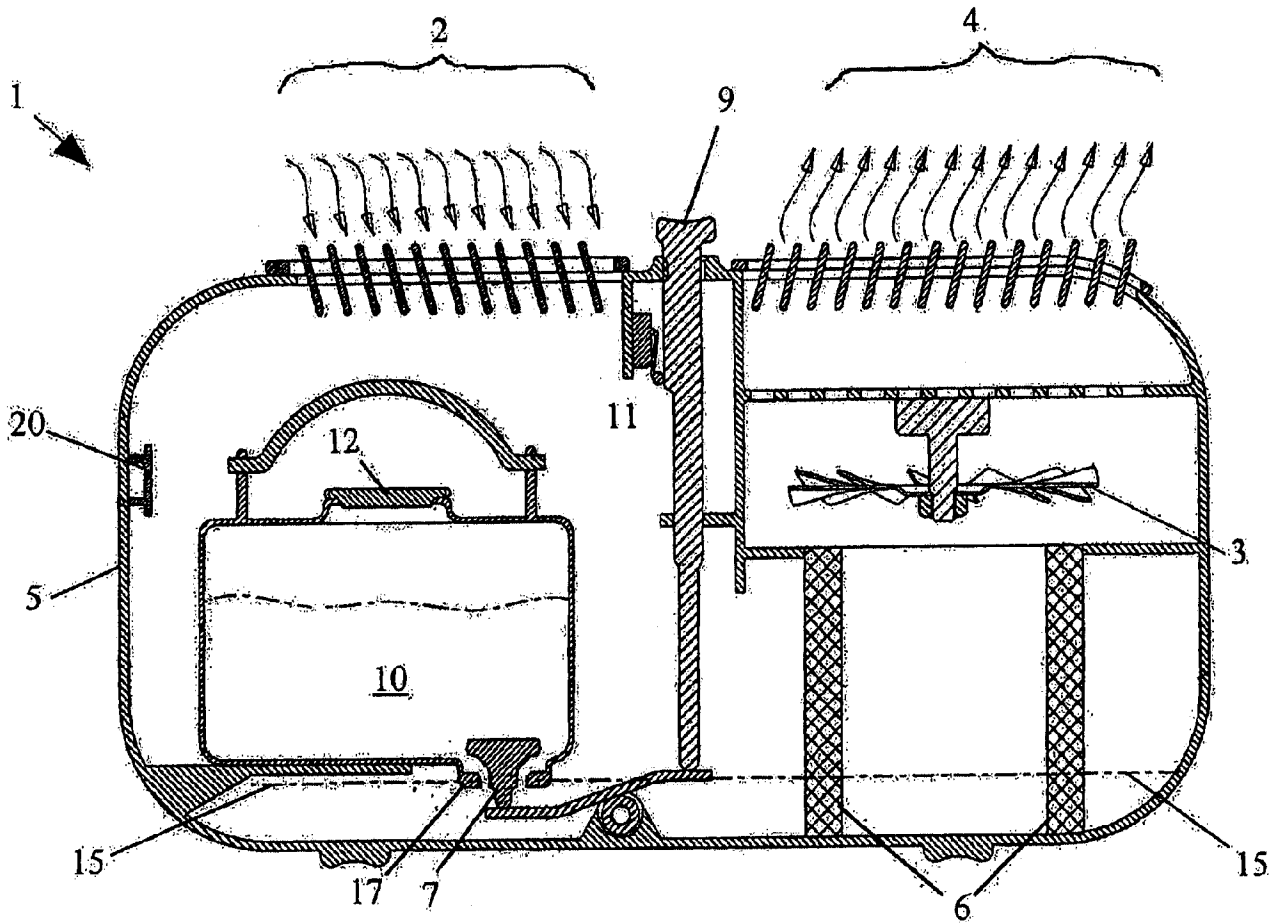
FIG. 2 is a cross-sectional view of an embodiment of the invention in an active mode.

Referring to FIG. 2, there is shown the humidifier 1 of the disclosure in an active state wherein the power shaft 9 has been depressed, thereby opening the feeder valve 7, activating the blower 3 via the power switch 11, and permitting a small and quickly-evaporable amount of water to flow from the first microorganism-resistant reservoir 10 into the second reservoir 5. There are many ways to design a feeder valve 7 to release only a limited amount of water. In the embodiment shown, this is simply and inexpensively achieved by positioning the feeder valve 7 on the bottom of the microorganism-resistant reservoir 10 and closing off the top of the microorganism-resistant reservoir 10 with a seal 12, such as a plug or screw cap.

When the feeder valve 7 is opened, water flows into the secondary reservoir 5 until the water level 15 reaches the feeder valve opening 17, thereby sealing the first reservoir 10 from ambient and blocking the flow of water from the primary reservoir 10 into the secondary reservoir 5. Hence, the humidifier 1 may be filled with a large quantity of water, which is held in the microorganism-resistant reservoir 10, yet simultaneously contain only a small, quickly-evaporable quantity of water exposed to the air stream in the bottom of the secondary reservoir 5. As water is evaporated from the secondary reservoir 5, the water level 15 drops, allowing additional water to top off the secondary reservoir.

Figure 3:
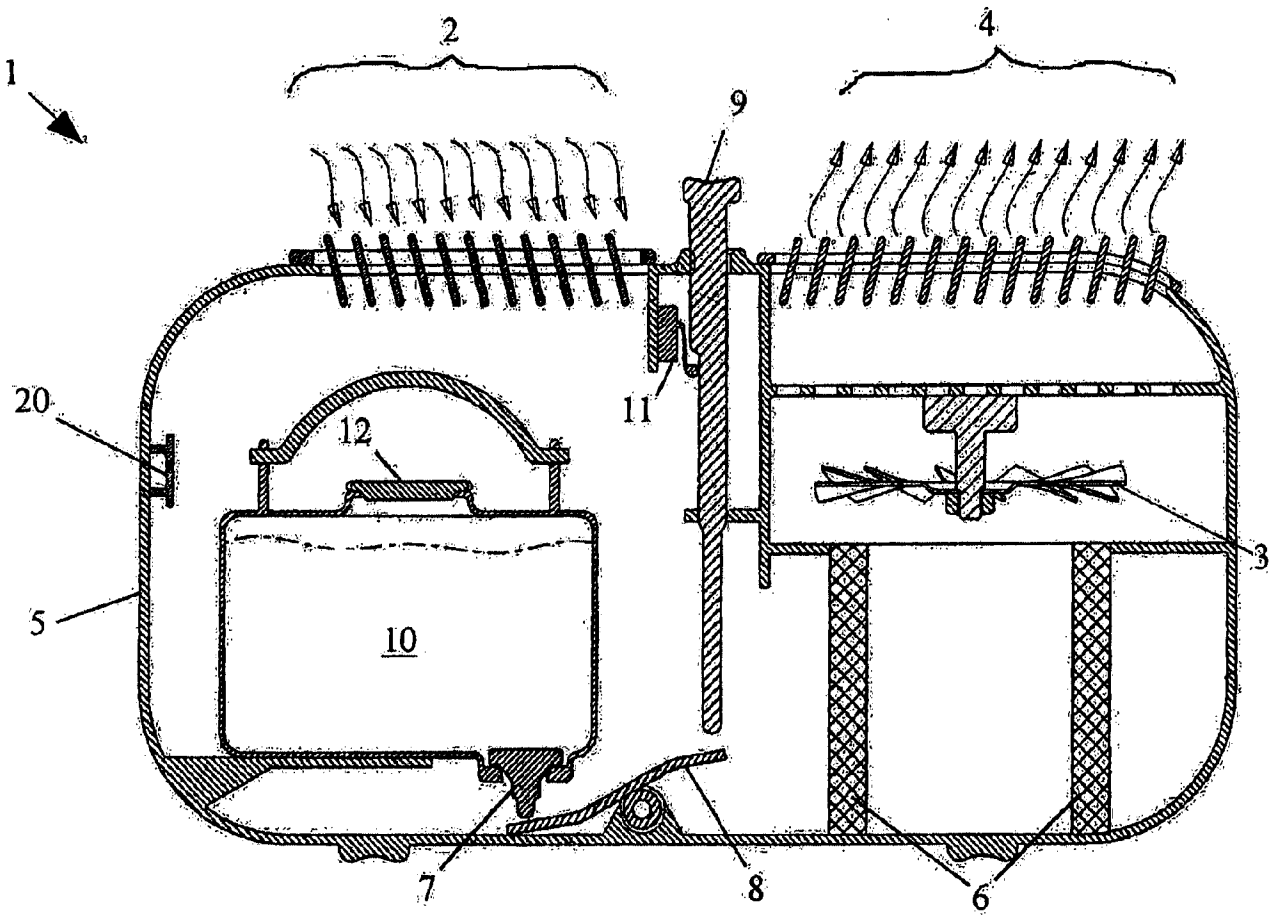
FIG. 3 is a cross-sectional view of an embodiment of the invention in a dry-out mode.

Referring to FIG. 3, there is shown a dry-out mode of the humidifier 1 wherein the power shaft 9 is raised, thereby sealing off the primary reservoir via the feeder valve 7 and opening power switch 11. A control circuit 20 connected to power switch 11 activates a timer to maintain power to the blower for a preset period of time upon receiving a signal that the power switch 11 has been opened. That is, the control circuit 20 keeps the blower 3 activated for a limited period of time even though the power switch 11 is off.

The control circuit is designed to keep the blower running until substantially all of the small, quickly-evaporable quantity of water is evaporated out of the microorganism-vulnerable reservoir 5. This includes any moisture in the wick 6, if a wick is utilized. Hence, the control circuit 20, the feeder valve 7, rocker arm 8 and power shaft 9 together provide a dry-out mechanism for the humidifier 1 in the embodiment shown.

Generally, it will be desirable to evaporate the water out of the secondary microorganism-vulnerable reservoir 5 within about an hour, preferably no more than thirty to forty-five minutes after the power switch has been raised. The exact evaporation time will of course vary with the relative humidity of the ambient atmosphere, the rate of airflow, and the quantity of quickly-evaporable water in the second reservoir and any wick, but these latter two factors may be determined without undue experimentation. In one embodiment, a timer in the control circuit 20 is activated when the power switch 9 is turned off so that the blower 3 continues to run for a predetermined period of time, such as 10, 20 or 30 minutes, so that any water remaining in the secondary reservoir 5 as well as in the filter 6 is exhausted through vents 4.

While various values, scalar and otherwise, may be disclosed herein, it is to be understood that these are not exact values, but rather to be interpreted as "about" such values, unless explicitly stated otherwise. Further, the use of a modifier such as "about" or "approximately" in this specification with respect to any value is not to imply that the absence of such a modifier with respect to another value indicated the latter to be exact.

Changes and modifications can be made by those skilled in the art to the embodiments as disclosed herein and such examples, illustrations, and theories are for explanatory purposes and are not intended to limit the scope of the claims. Further, the abstract of this disclosure is provided for the sole purpose of complying with the rules requiring an abstract so as to allow a searcher or other reader to quickly ascertain the subject matter of the disclosures contained herein and is submitted with the express understanding that it will not be used to interpret or to limit the scope or the meaning of the claims.

What is claimed is:

1. A microorganism-resistant humidifier, comprising:

a first reservoir having a predetermined water capacity;

a second reservoir;

a blower adapted to blow a stream of air through the humidifier and out to an ambient atmosphere, such that the stream of air picks up water vapor from water that may be in the second reservoir;

a valve adapted to feed a quickly-evaporable quantity of water from the first reservoir into the second reservoir, the quickly-evaporable quantity of water being substantially smaller than the water capacity of the first reservoir; and a dry-out mechanism adapted to shut off the valve upon a user command and to continue to run the blower until the quickly-evaporable quantity of water has evaporated to an extent effective to inhibit the growth of microorganisms in the second reservoir.

2. The microorganism-resistant humidifier of claim 1 further comprising one or more wicks receiving water from said second reservoir.

3. The microorganism-resistant humidifier of claim 1 wherein said first reservoir is sealed and feeds water downward into said second reservoir.

4. The microorganism-resistant humidifier of claim 1 wherein said quickly-evaporable quantity of water is substantially evaporated within no more than one hour by said dry-out mechanism.

5. A microorganism-resistant humidifier comprising:

a first reservoir sealable from ambient;

a second reservoir communicating with the first reservoir and said ambient;

a blower for providing a stream of air through the humidifier and out to said ambient, such that the stream of air picks up water vapor from any water that may be in the second reservoir;

a valve for feeding a quickly-evaporable quantity of water from the first reservoir into the second reservoir, the quickly-evaporable quantity of water being substantially smaller than the water capacity of the first reservoir; and a dry-out system for shutting off the valve upon a user command and continuing to run the blower at least until the quickly-evaporable quantity of water has evaporated to an extent effective in inhibiting the growth of microorganisms in the second reservoir.

6. The microorganism-resistant humidifier of claim 5 further comprising one or more wicks.

7. The microorganism-resistant humidifier of claim 5 wherein said first reservoir is sealed and feeds water downward into said second reservoir.

8. The microorganism-resistant humidifier of claim 5 wherein said quickly-evaporable quantity of water is substantially evaporated within no more than one hour by said dry-out mechanism.

9. The microorganism-resistant humidifier of claim 5, wherein said dry-out system comprises a timer for continuing running of the blower for a period of time after said user command.

10. The microorganism-resistant humidifier of claim 5, wherein water in said second reservoir seals said first reservoir from ambient.

11. A humidifier, comprising:

a first reservoir;

a second reservoir;

a valve for releasing water from said first reservoir into said second reservoir;

a fan blowing air across said water in said second reservoir and into ambient atmosphere;

a power switch for activating said fan; and a user operated switch assembly comprising a cam member engageable with said power switch and adapted to operate said valve and said fan.

12. The humidifier of claim 11, further comprising a timer adapted to receiving a signal from said switch assembly.

13. The humidifier of claim 11, further comprising a timer connected to said switch assembly, said timer controlling operation of said fan after said switch assembly is positioned to deactivate said fan.

14. The humidifier of claim 13, wherein said timer maintains activation of said fan for a predetermined period of time after said switch is positioned to deactivate said fan.

15. The humidifier of claim 11, wherein said switch assembly mechanically operates said valve.

16. The humidifier of claim 11, wherein said switch assembly electrically operates said fan.

17. A humidifier, comprising;

a first reservoir;

a valve for releasing water from said first reservoir into said humidifier;

a fan blowing air across water in said humidifier and into ambient atmosphere; and a user operated switch comprising a user movable shaft having a switch engaging cam portion for activating said fan and a valve-activating portion on said shaft for operating said valve.

* * * * *